United States Patent [19]

Leach

[11] Patent Number: 5,067,725

[45] Date of Patent: Nov. 26, 1991

[54] NUMBER-SENSE CARD GAME

[76] Inventor: Leonora M. Leach, 113-15 34th Ave., Corona, N.Y. 11368

[21] Appl. No.: 621,090

[22] Filed: Dec. 3, 1990

[51] Int. Cl.[5] ..... A63F 1/00; G09B 19/02; G09B 19/22

[52] U.S. Cl. ..... 273/302; 273/299; 273/308; 434/205

[58] Field of Search ..... 273/302, 299, 303-306, 273/308, 292, 293; 434/205, 207, 188

[56] References Cited

U.S. PATENT DOCUMENTS

| | | | |
|---|---|---|---|
| 1,007,460 | 10/1911 | Legh | 273/305 |
| 1,530,568 | 3/1925 | Mansfield | 273/305 |
| 1,854,999 | 4/1932 | Ralls | 434/205 |
| 3,758,962 | 9/1973 | Bagdasar | 434/205 |

*Primary Examiner*—Benjamin Layno

[57] ABSTRACT

The present invention, designed especially for preschoolers, is a number-sense card game comprising four decks of one, number, and word cards, representing the numbers from one to ten. As the players have fun playing cards, they name the one cards by counting their ones; they name the numbers on the cards; they name the words on the cards; and they show the correct sequence of the numbers, expressed in ones, numbers, and/or words. The players can win this card game without using up all the cards in a deck. They merely have to have the most stars, which are exchanged for points earned when on the first try, players name a one, number, or word card or show the correct sequence of the numbers. As the players play with the present invention, they have fun, show what they know, and see that numbers make sense.

1 Claim, 3 Drawing Sheets

NUMBER-SENSE CARD GAME

FIELD OF THE INVENTION

The present invention relates to card games. More specifically, the present invention relates to number-sense card games.

BACKGROUND OF THE INVENTION

Card games are played by adults or are a family-type game, as the game by Chamblee and Williamson U.S. Pat. No. 4,807,885.

Usually, the mathematical card games played by children require that the players solve a mathematical problem.

This type of game is seen in the game by Nason and Bailey U.S. Pat. No. 3,206,872 referred to as a teaching aid.

In those mathematical games that a preschooler can play, it is not clear what a given number represents.

Martin U.S. Pat. No. 2,782,039 designed such a game. Her game comprises numbers with their representative words.

But what do these numbers mean?

SUMMARY OF THE INVENTION

The present invention is geared especially to preschoolers. preschoolers like to test their knowledge; they enjoy showing what they know; and they love to play cards the way grownups do. While playing with the present card game, comprised of one cards, number cards, and word cards, players see that numbers make sense.

For example, the object of playing with the one cards is to name the cards by counting their ones.

The object of playing with the number cards is to see and name the numbers on the cards.

The object of playing with the word cards is to see and name the words on the cards.

Finally, the object of playing with the one, number, and word cards is to show the correct sequence of the numbers.

Other objects will be seen as this card game is played.

The descriptions of the drawings and of the preferred embodiment are merely illustrative of the present invention.

DESCRIPTION OF THE PREFERRED EMBODIMENT

Figure 1:
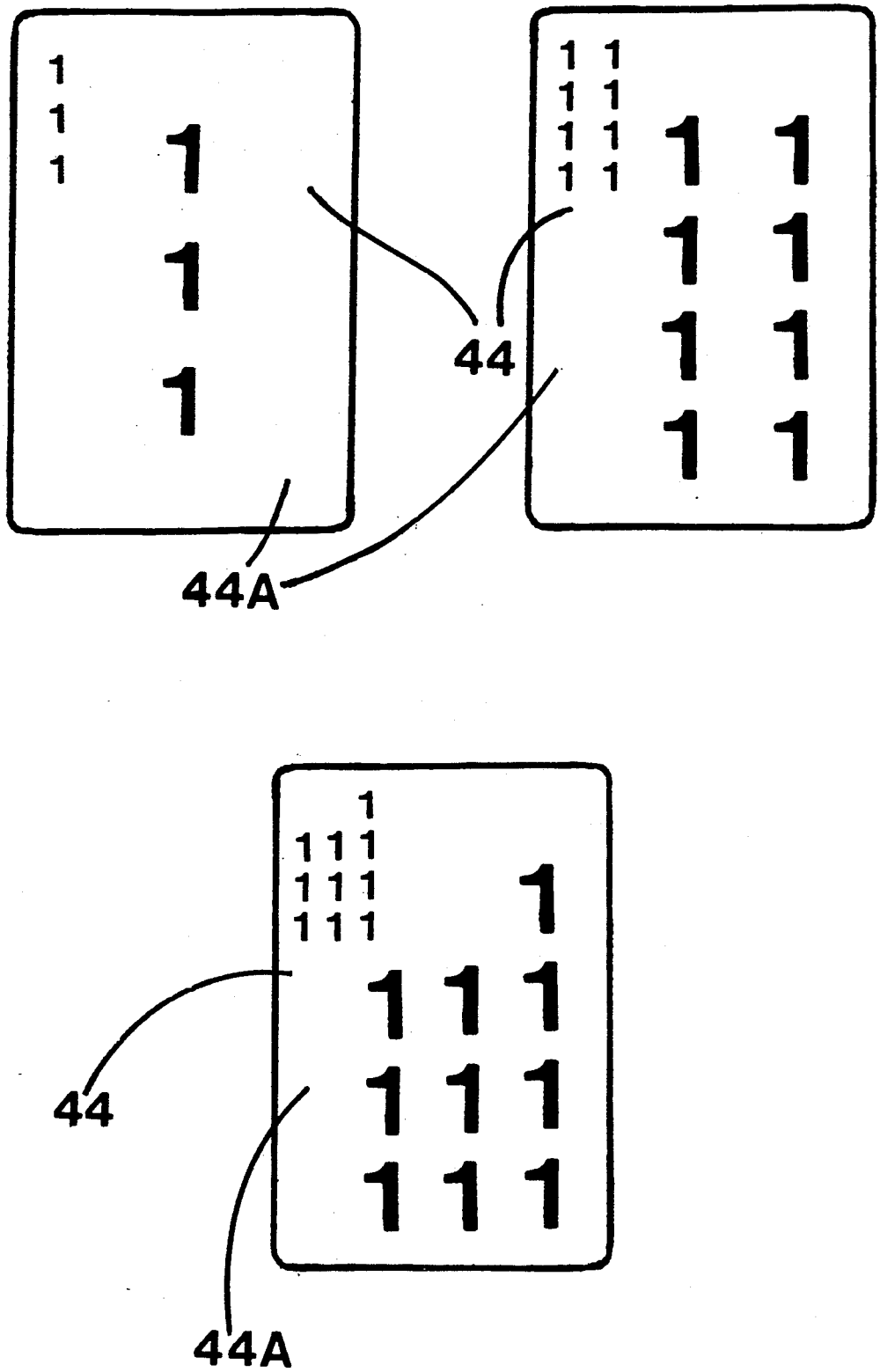
FIGS. 1-3 illustrate the one, number, and word cards.
Figure 2:
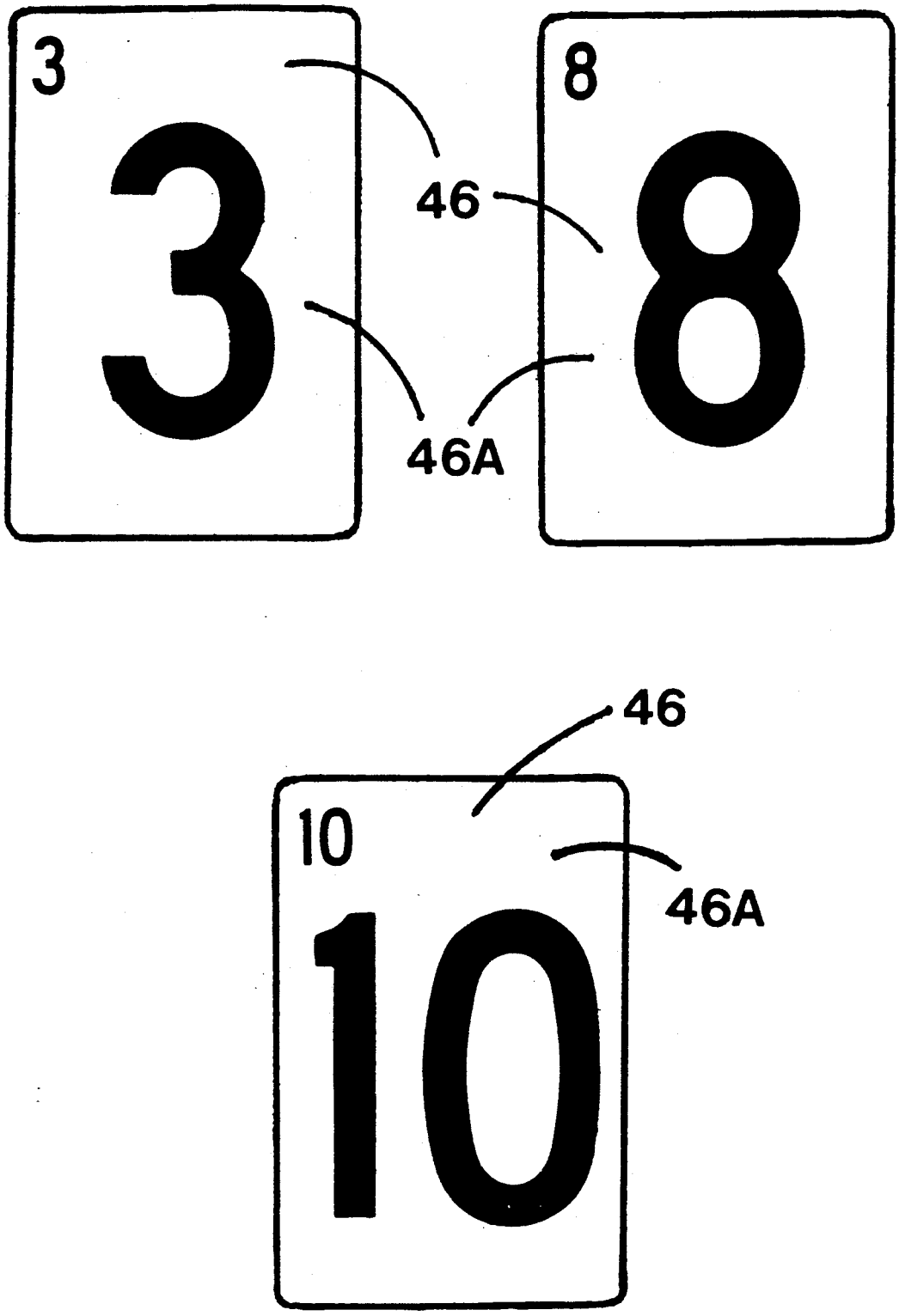
Figure 3:
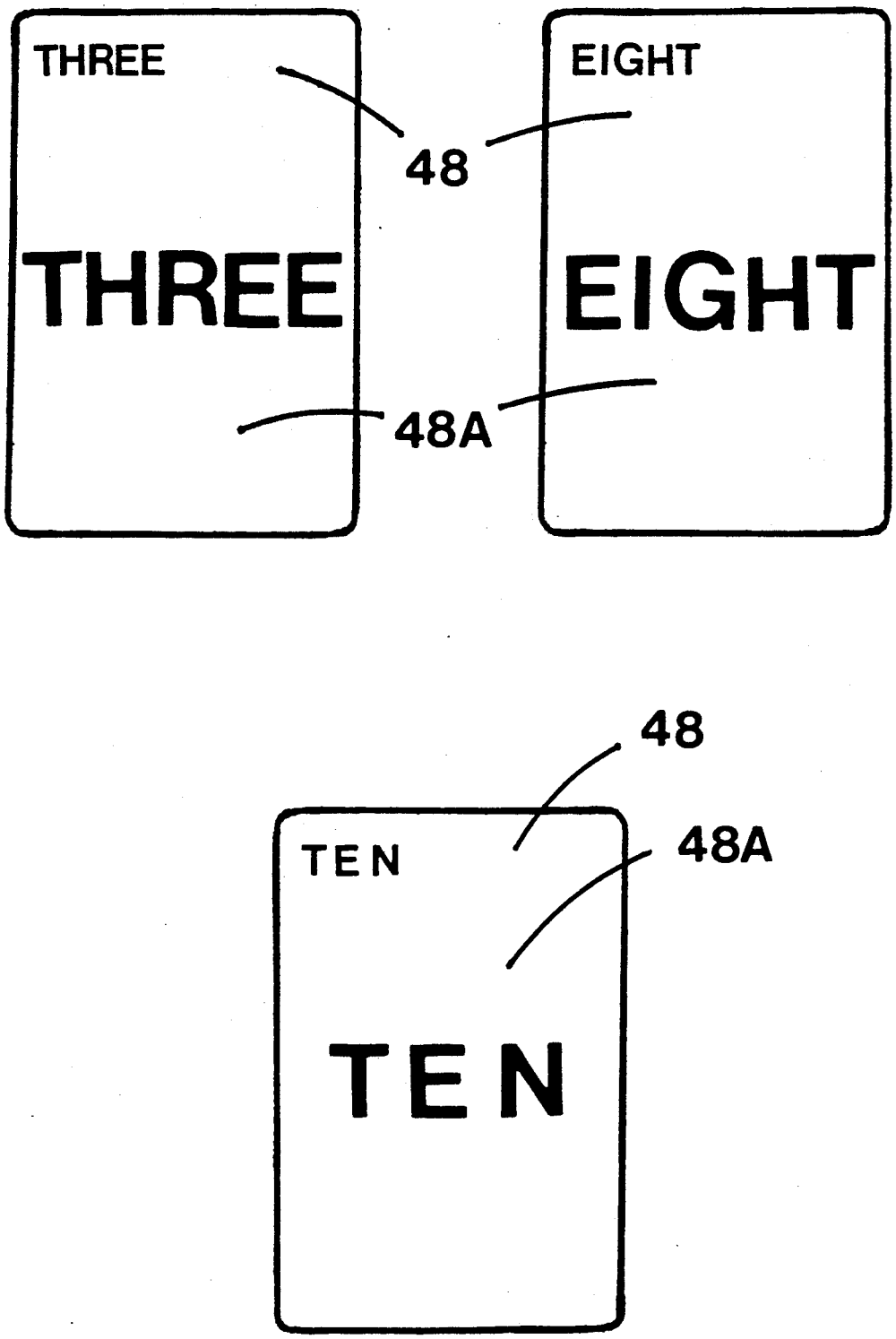

The present invention is a card game comprising four decks of cards. The one cards 44 in FIG. 1 have one deck; the number cards 46 in FIG. 2 have one deck; the word cards 48 in FIG. 3 have one deck; and the one, number, and word cards 44*a*, 46*a*, and 48*a* in FIGS. 1-3 have one deck. There are thirty one cards 44, thirty number cards 46, thirty word cards 48, and thirty one, number, and word cards 44*a*, 46*a*, and 48*a*. Each deck has three cards for each number.

In this number-sense card game, the table is treated as a player without a turn. The middle of the table is used so that it can be easily seen by all the players. All the table's cards are dealt face up, and the palyers utilize these cards to their advantage. For example, if a player sees a card with ones, a number, or a word that he or she has, the player can put down his or her card on that of the table's, or if some cards look alike, the player can combine these cards in one pile and still have a turn. The small replicas of the ones, numbers, or words on the card's upper left-hand corner allow easy viewing.

When playing with the one cards 44, the object is to name each card counting its ones. After all the cards are given out, the first player puts down a card and names it by counting its ones. A volunteer player or the game monitor says if the counting and the naming have been correct. If not, the correct count and name are given. The fingers are used to demonstrate the counting of the ones and the card's correct name. The next player has the option of putting down the matching card and naming it or putting down a different card and naming it by counting its ones. A volunteer player or the game monitor assesses the counting of the ones and the naming of the cards as needed. The players continue in this way until all the cards are used. Counting the ones and naming a card correctly on the first try earn a point. In this card game, three points earn a star, and the player with the most stars wins. It is not necessary to finish a game. The player with the most stars always wins.

The object of playing with the number cards 46 is to see and name the numbers on the cards. After all the cards are given out, the first player puts down a card and names its number. A volunteer player or the game monitor says if the number has been named correctly. If not, the correct name is given, and the corresponding number of fingers are held up to show what the number means. The next player has the option of putting down and naming the same number or a different one. Each number has its own pile, and the players throw off in the correct pile numbers that have already been used. A volunteer player or the game monitor assesses the naming of the numbers as needed. The players take turns in this way until all the cards are used. The correct naming of a number on the first try earns a point.

The object of playing with the word cards 48 is to see and name the words on the cards. After all the cards are given out, the first player puts down a card and names its word. Each word on a card is the name of a number from one to ten. The player uses familiar names or words with the same beginnig letter to help name the word. A volunteer player or the game monitor says if the word has been named correctly. If not, the correct name is given. The next player has the option of putting down and naming the same word or a different one. Each word has its own pile, and the players throw off in the correct pile words that have already been used. A volunteer player or the game monitor assesses the naming of the words as needed. The players take turns in this until all the cards are used. The correct naming of a word on the first try earns a point.

Finally, the object of playing with the one, number, and word cards 44*a*, 46*a*, and 48*a* is to show the correct sequence of the numbers, continuing the sequence in any direction with a higher or lower number. This sequence can be shown in ones, numbers, or words. After all the cards are given out, the first player puts down a card and names its number. A volunteer player or the game monitor says if the number has been named correctly. If not, the correct name is given. The next player has the option of continuing the sequence by putting down a higher or a lower number or of putting down the same number expressed differently. For example, suppose the first player puts down a five number card 46 and names its number. The next player can continue the sequence with any of eight possibilities. The sequence can be continued with a five one card 44 or with a five word card 48. Also, the sequence can be continued with six expressed in ones, as a number, or as a word. In addition, the sequence can be continued with four expressed in ones, as a number, or as a word. The sequence is maintained as the ones, numbers, or words are matched but placed in different lines. A volunteer player or the game monitor assesses the sequence and the naming of the numbers as needed. The players continue to take turns in this way until all the cards are used. A point is earned when the sequence of the numbers is maintained and the number is named correctly on the first try.

In the present invention, points are earned as the players exhibit their skill. Also, the present number-sense card game, which was designed especially for preschoolers, is challenging and interesting.

What is claimed is:

1. A number-sense card game for representing the numbers from one to ten in three different ways comprising in combination:

a first deck of cards representing numbers in a first way wherein each card of said first deck having a number of "1" digits printed thereon corresponding to a number from one to ten, wherein a card having a single "1" digit represents the number one, and a card having ten "1" digits represents the number ten, a small replica of which is printed on one of the upper corners of said cards;

a second deck of cards representing numbers in a second way wherein each card of said second deck having a single numerical character representing a number from one to ten, a small replica of which is printed on one of the upper corners of said cards;

a third deck of cards representing numbers in a third way wherein each card of said third deck having a word naming a number from one to ten, a small replica of which is on one of the upper corners of said cards;

a fourth deck of cards representing numbers in all said three ways wherein a first set of cards in said fourth deck having a number of "1" digits printed thereon, a second set of cards in said fourth deck having a single numerical charater printed thereon, and a third set of cards in said fourth deck having a word naming a number from one to ten, wherein all three sets of cards represent the numbers from one th ten.

* * * * *